US005820430A

United States Patent [19]

Hornsby et al.

[11] Patent Number: 5,820,430

[45] Date of Patent: Oct. 13, 1998

[54] DUAL AQUAPLANING CRAFT

[76] Inventors: William G. Hornsby; Jane A. Hornsby, both of 6161 N. Indigo Ave., San Bernardino, Calif. 92407; Jeffrey M. Meyers, 4490 Highland Pl., Riverside, Calif. 92506

[21] Appl. No.: 949,018

[22] Filed: Oct. 10, 1997

[51] Int. Cl.[6] ..... B63B 1/00

[52] U.S. Cl. ..... 441/65; 441/74

[58] Field of Search ..... 114/364, 362, 114/363; 280/845, 18; 441/65, 66, 67, 68, 69, 70, 74, 79, 129, 130, 131, 132

[56] References Cited

U.S. PATENT DOCUMENTS

| | | | |
|---|---|---|---|
| 3,156,483 | 11/1964 | See | 280/18 |
| 4,115,888 | 9/1978 | Sievers | 441/132 |
| 4,421,491 | 12/1983 | Pleass | 441/74 |
| 4,530,299 | 7/1985 | Ross . | |
| 4,669,992 | 6/1987 | Morris | 441/65 |
| 4,789,365 | 12/1988 | Jones . | |
| 5,080,620 | 1/1992 | Reden | 441/68 |
| 5,399,111 | 3/1995 | Kobayashi et al. . | |

*Primary Examiner*—Stephen Avila
*Attorney, Agent, or Firm*—Sheldon & Mak

[57] ABSTRACT

An unpowered planing craft for a side-by-side pair of riders includes a bifurcated hull having rearwardly projecting and laterally diverging leg portions, and a laterally spaced pair of restraint members connectable near opposite edges at forward extremities of each leg portion for holding respective ones of the riders kneeling side-by-side on a deck surface of the hull. In a preferred version, the hull is approximately 46 inches wide and approximately 48 inches long, inside edges of the leg portions diverging rearwardly approximately 30° from longitudinal hull axis. A forward perimeter outline portion ahead of outer extremities of the leg portion extend convexly outwardly and forwardly to a forward extremity of the hull. A resilient pad is affixed to the hull in flush relation to the deck surface for comfortably supporting the riders. The hull is formed with a plurality of longitudinal channel passages formed therein as stabilizers, and a pair of interchangeable skeg members for facilitating cutting maneuvers.

25 Claims, 3 Drawing Sheets

DUAL AQUAPLANING CRAFT

BACKGROUND

The present invention relates to planing devices for traversing fluidic media such as water and snow, and more particularly to unpowered craft such as body boards and the like.

Body boards are well known, typically having a board-shaped hull including one or more downwardly projecting stabilizers, an upper deck surface for supporting a rider, and a restraining device such as a strap for holding the rider in place. These devices are typically used for surfing, downhill skiing, as well as being towed behind a vehicle with the rider holding a tow rope. Body boards that are to be towed are mounted from a prone position in the water, by holding the tow line with one hand and grasping the board with the other as towing is initiated. Once planing ensues, the rider assumes a kneeling position; then, while again holding the line with one hand, restraining devices are put on with the other hand, after which both hands are free to hold the tow line.

U.S. Pat. No. 5,399,111 to Kobayashi et al. discloses a powered craft having a partial deck for supporting upper torsos of a side-by-side pair of riders whose legs trail in the water. It is believed desirable to provide an unpowered craft for side-by-side riders that are completely supported on the craft. However, the configuration of Kobyashi et al. but without the propulsion device is believed to be unsuitable for such use for a number of reasons. For example:

1. The craft would be unstable without the trailing legs of the riders or independent laterally spaced propulsion devices; and
2. The craft would have little if any directional control.

Thus there is a need for an unpowered craft for a side-by-side pair of riders that is both stable and controllable while completely supporting the riders.

SUMMARY

The present invention meets this need by providing a bifurcated hull configuration for supporting a side-by-side pair of riders. In one aspect of the invention, the craft includes a hull having rearwardly projecting and laterally diverging leg portions, a downwardly and outwardly facing planing surface for supportively engaging a fluidic medium when the hull moves forwardly relative to the medium, an upwardly facing deck surface, and a perimeter outline, the deck surface having an area sufficient for supporting side-by-side human bodies kneeling proximate respective front extremities of the leg portions; stabilizer means laterally spaced substantially within respective ones of the leg portions for interacting with the medium; and a laterally spaced pair of adjustable restraint members extending upwardly from the hull, each of the restraint members being adapted for restraining a respective one of the riders on the deck surface.

Preferably the deck has a deck width proximate the forward extremities of the leg portions, the deck width being not less than approximately 24 inches for accommodating the riders side-by side. The hull has a hull width being preferably not greater than approximately 70 inches for effective directional control of the craft. The deck width can be not less than approximately 36 inches for accommodating adult riders, the hull width being not greater than approximately 55 inches for limiting wave-induced yawing of the craft. Most preferably, the deck width is approximately 40 inches, the hull width being approximately 46 inches for combining comfortable spacing of the riders and enhanced maneuverability of the craft.

The hull can have a length being between approximately 90 percent and approximately 120 percent of the hull width. In one preferred configuration, the hull length is approximately 113 percent of the hull width.

Preferably the perimeter outline diverges rearwardly along inside edges of the leg portions on opposite sides of a longitudinal axis of the hull for enhancing maneuverability and directional control of the craft, the longitudinal axis projecting rearwardly from the perimeter outline at a reference location, each leg portion having a leg width and a corresponding leg spacing from the longitudinal axis at a leg distance rearwardly of the reference location, a total of the leg width and spacing, where the leg distance is approximately 40 percent of an overall hull width of the hull, being approximately equal to half of the hull width. Further, the divergence of the inside edges of the leg portions can be at a angle of approximately 30° from the longitudinal axis. Also, the leg width can be approximately 25 percent of the hull width where the leg distance is 40 percent of the hull width. The leg distance can be approximately 40 percent of the hull width proximate rear extremities of the leg portions. The perimeter outline can extend to the hull width at outer extremities of the leg portions. Rear extremities of the leg portions can extend to proximate the hull width. A forward portion of the perimeter outline ahead of the outer extremities of the leg portions can extend convexly outwardly and forwardly to a forward extremity of the hull. A forward portion of the perimeter outline ahead of the outer extremities of the leg portions can form a substantially elliptical arc.

The hull can include a rigid structure having a resilient pad affixed thereto, the deck surface extending on an upper surface of the resilient pad. Each of the restraint members can be connectable between a pair of anchor members that are located proximate opposite edges of a respective leg portion, the pad extending between the anchor members. The rigid structure can include a shell portion and a plurality of reinforcing members fixedly located within the shell portion, the anchor members being fastened to respective ones of the reinforcing members. Preferably the shell portion has a depression formed therein for receiving the pad and the anchor members. Each restraint member can include a flexible strap, each anchor member including an arch segment, one end of the strap being looped about and secured to the arch segment of one anchor member, the strap having a strap fastener for adjustably connecting the strap to the arch segment of another anchor member.

Preferably the stabilizer means comprises pair of stabilizer mounts for holding respective stabilizer members longitudinally extending on the hull surface and projecting downwardly therefrom. Each stabilizer mount can include a reinforcing member within the hull, a threaded opening extending into the reinforcing member from the hull surface for receiving a stabilizer fastener. The planing craft can include a pair of downwardly projecting, longitudinally extending skeg members connected to respective ones of the reinforcing members. The stabilizer means can further include the hull surface having at least one laterally spaced pair of channel passages formed therein, each channel passage extending longitudinally from proximate a forward extremity of a respective leg portion, rearwardly to the perimeter outline.

DRAWINGS

These and other features, aspects, and advantages of the present invention will become better understood with reference to the following description, appended claims, and accompanying drawings, where:

DESCRIPTION

Figure 1:
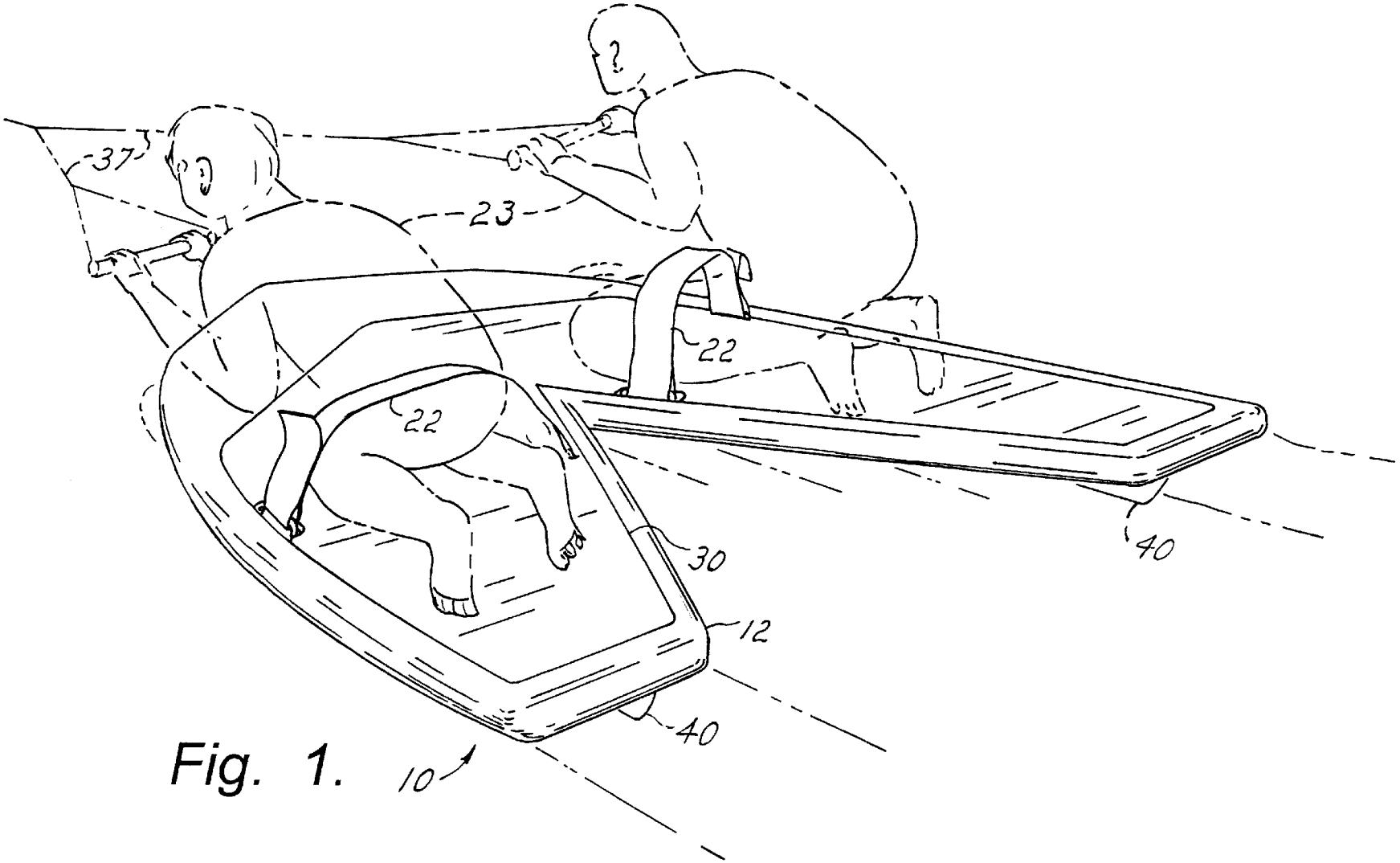
FIG. 1 is a rear-oblique perspective view of an unpowered planing craft according to the present invention.
Figure 5:
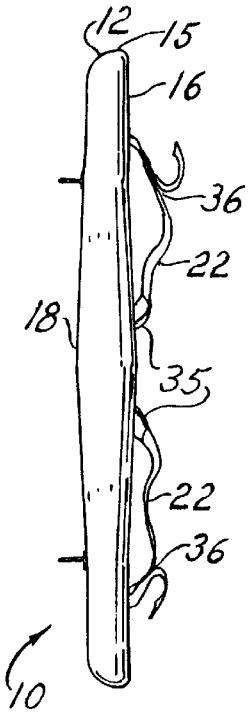
FIG. 5 is a front view of the craft of FIG. 1.

The present invention is directed to a planing craft that is particularly effective in carrying and being controlled by a side-by-side pair of riders. With reference to FIGS. 1–8 of the drawings, a planing craft 10 includes a bifurcated hull 12 including diverging trailing leg portions 14, the hull having a generally V-shaped perimeter 15, a generally horizontal deck surface 16, and a contoured planing surface 18. The planing surface 18 is formed with a laterally spaced pairs of stabilizers 20 longitudinally extending on the planing surface 18 under the leg portions 14 as further described below. The craft 10 also includes a laterally spaced pair of restraint devices 22 being anchored to the hull 12 for holding respective riders 23 on the deck surface 16 proximate forward extremities of the leg portions 20 as shown in FIG. 1.

Figure 7:
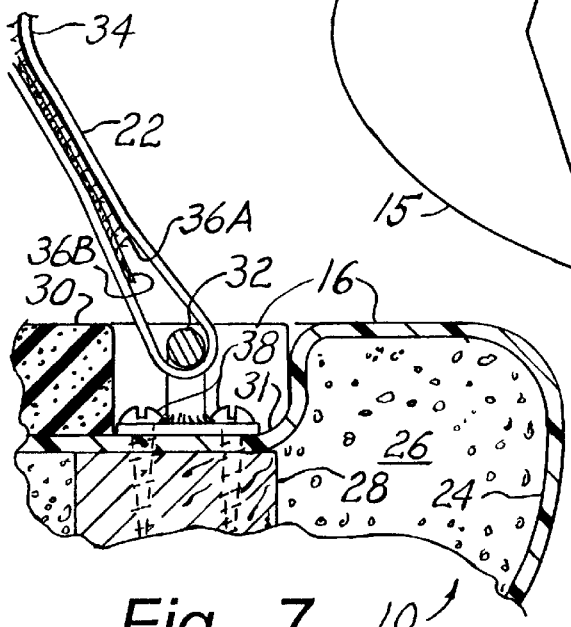
FIG. 7 is a fragmentary sectional elevational view of a portion of the craft of FIG. 1.

The hull 12 is typically formed having a contoured shell 24 that can be built-up fiberglass, the shell 24 being filled with a lightweight reinforcing core 26 and, preferably, suitable reinforcing blocks 28 that are located for anchoring the restraint devices 22 as shown in FIG. 7. The deck surface 16 extends partly on a resilient pad 30, the shell 24 having a shallow depression 31 under the pad 30 for obtaining a flush deck contour, the pad 30 being attached by any suitable means such as a water-impervious adhesive. Each of the restraint devices 22 includes a pair of arched anchor bars 32 and an adjustable strap 34. In an exemplary configuration shown in the drawings, one end of the strap 34 is permanently connected to one of the bars 32 such as by a conventional stitched loop 35, the other end of the strap having an adjustable fastener 36 being a longitudinally displaced pair of hook-loop fastener elements 36A and 36B for adjustably connecting the strap to the other of the bars. Thus the riders 23 can be restrained on the deck surface 16 side-by-side in kneeling positions, the craft 10 being towable behind a suitable vehicle (not shown) by a suitable tow line 37 as shown in FIG. 1. Preferably the tow line 37 is of the type having a single rope with two full-sized handles, because riders need to have one hand free while mounting, for grasping the hull member 12.

The bars 32 are each anchored to the hull 12 within the depression 31 using a plurality of anchor fasteners 38 that threadingly engage respective ones of the reinforcing blocks 28. Preferably the bars 32 have a sufficiently low profile that they do not project above the deck surface 16, the surface 16 being free of rigid obstructions that might present hazards to the riders 23. More particularly, the resilient pad has a thickness of approximately 1.0 inch, the bars 32 being of lesser height.

Figure 8:
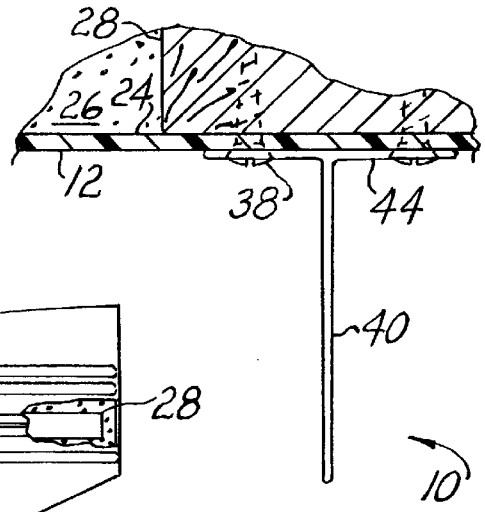
FIG. 8 is a fragmentary sectional elevational view of another portion of the craft of FIG. 1.

The stabilizers 20 preferably include at least one pair of skegs 40 that project downwardly from the planing surface 18 within respective ones of the leg portions 14 for facilitating cutting maneuvers. In the preferred implementation of the drawings, the skegs 40 are removable for interchange with counterparts having different configurations, thereby to effect a desired balance of stability and control of the craft 10 for riders having divergent physiques and skill levels. Accordingly, the hull has counterparts of the reinforcing blocks 28 fixedly located within the shell 24 for receiving counterparts of the anchor fasteners 38 by which the skegs 40 are affixed to the hull 12 as shown in FIG. 8. Each skeg 40 is formed with a flange portion 44, the fasteners 38 extending through the flange for clamping the skeg 40 against the planing surface 18 of the hull 12. Exemplary skegs 40 are approximately 14 inches long and 1.9 inches tall. It will be understood that the skegs 40 can made adjustable for length, longitudinal position, and/or for variable draft, such as by retracting into the hull 12.

Figure 4:
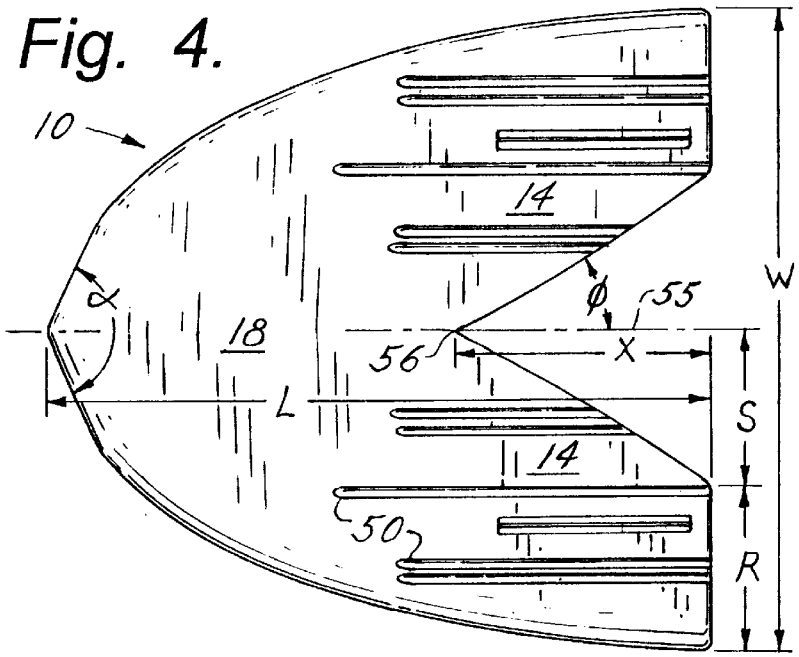
FIG. 4 is a bottom plan view of the craft of FIG. 1.
Figure 6:
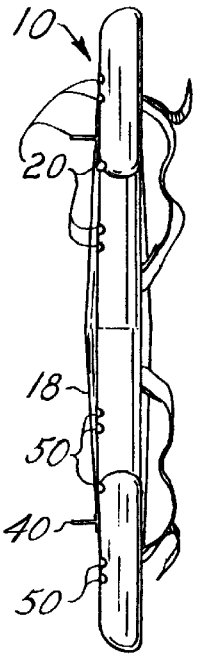
FIG. 6 is a rear view of the craft of FIG. 1.

The stabilizers 14 can also include symmetric pairs of longitudinal depressions or channels 50 that are formed in the planing surface 18 substantially within the leg portions 20 as shown in FIGS. 4 and 6. As shown in the drawings, the stabilizers 14 as well as the restraint devices 22 are spaced symmetrically on opposite sides of a longitudinal axis 55 of the craft 10, the hull 12 also having lateral symmetry on opposite sides of the axis 55. The channels 50 can be formed, for example, having respective widths and depths of approximately 0.75 inch, with lengths ranging from approximately 18 inches to approximately 28 inches.

Figure 2:
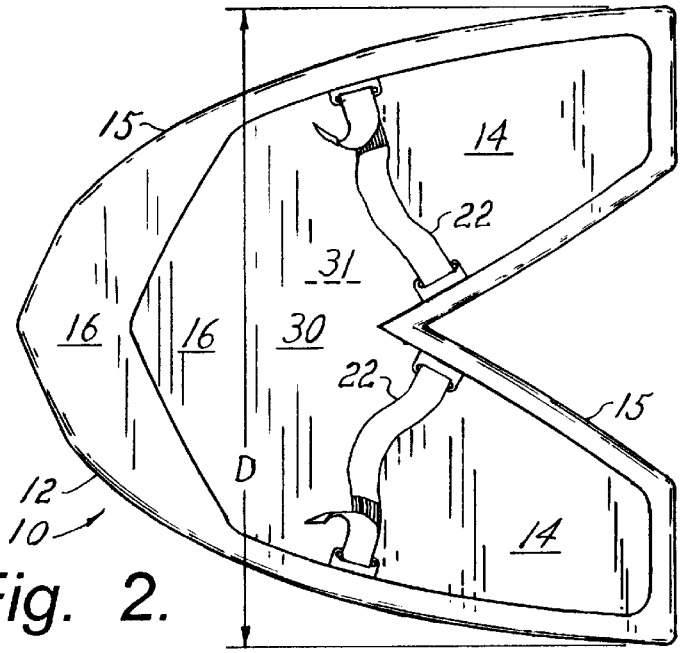
FIG. 2 is a top plan view of the craft of FIG. 1.
Figure 3:
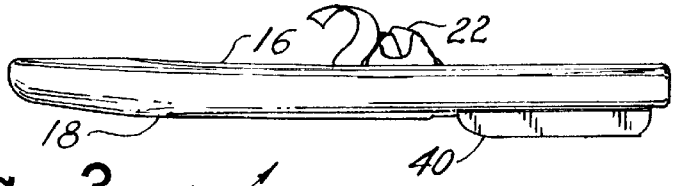
FIG. 3 is a side elevational view of the craft of FIG. 1.

The hull 12 has a width W and a length L as shown in FIG. 4, the deck surface 16 also having a width D proximate forward extremities of the leg portions 20 as shown in FIG. 2. The deck width D is preferably at least approximately 24 inches for accommodating the riders 23 side-by side as shown in FIG. 1. The hull width W is not greater than approximately 70 inches for permitting effective directional control of the craft 10. Preferably the deck width is at least approximately 36 inches for accommodating side-by-side adults as the riders 23, the hull width W being not greater than approximately 55 inches for limiting wave-induced yawing of the craft 10. More preferably, the deck width D is approximately 40 inches for permitting the riders 23 to be comfortably spaced adults, the hull width W being approximately 46 inches for enhanced maneuverability of the craft 10.

In preferred configurations of the craft 10, the hull length L is between approximately 90 percent and approximately 120 percent of the hull width W. Particularly in the configuration of FIGS. 1–8, the length L is approximately 103 percent of the width W, being approximately 47.5 inches when the width W is 46 inches.

As further shown in the drawings, the perimeter contour 15 diverges approximately at an angle $\phi$ of approximately 30° rearwardly along inside edges of each of the leg portions 14 from a reference point 56 on the hull 12 from which the longitudinal axis 55 projects. Rear extremities of the leg portions 14 have a lateral width R, being spaced from the longitudinal axis 55 by a leg spacing S. As shown in FIG. 4, the lateral width R is measured at a leg distance X rearwardly of the reference location 56, the distance X also being to rear extremities of the leg portions 14, the width R plus the spacing S being half of the width W. Further, the width R is approximately equal to the spacing S, each being approximately half of the hull width W. The leg distance X is also shown as being approximately 40 percent of the hull width W. It will be understood, moreover, that the leg portions 14 can extend rearwardly from the rear terminus of the leg distance X in that the perimeter contour 15 can be convexly curved within the leg widths R; thus the leg distance X is not necessarily to the rear extremities of the leg portions 14. In other words, the leg width R plus the leg spacing S at the leg distance X being approximately 40 percent of the hull width W is approximately half of the hull width.

FIGS. 2 and 4 also show the perimeter contour 15 being convex outwardly and forwardly of rear extremities of the leg portions 14, the contour 15 being only slightly curved for some distance on opposite sides of the longitudinal axis 55 and forming a bow angle $\alpha$ being approximately 130°. The perimeter contour 15 is also convexly bowed slightly toward the longitudinal axis 55 along inside edges of the leg portions 14.

Figure 9:
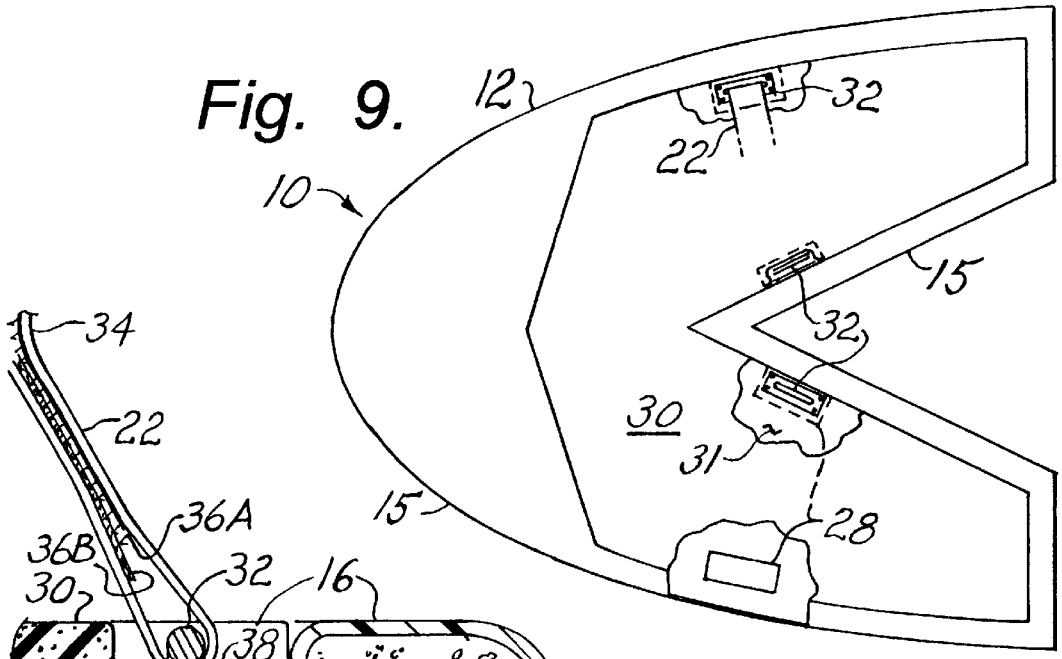
FIG. 9 is a fragmentary sectional top plan view showing an alternative configuration of the craft of FIG. 1.
Figure 10:
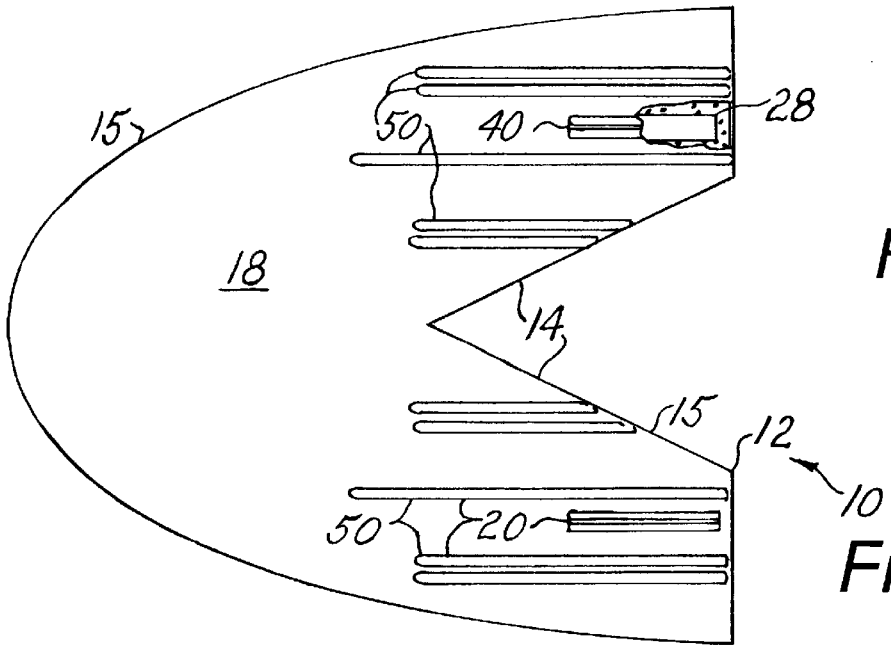
FIG. 10 is a bottom plan view of the craft of FIG. 10.

With further reference to FIGS. 9 and 10, an alternative configuration of the hull 12 is formed with an outside portion of the perimeter contour 15 being an elliptical arc. In this alternative configuration, the contour 15 is straight along the inside edges of the leg portions 14.

Although the present invention has been described in considerable detail with reference to certain preferred versions thereof, other versions are possible. For example, resilient pad 30 can be contoured for fitting rider's knees or other body parts. Also, the hull 12 can be hinged along the longitudinal axis 55, a suitable latch being provided for maintaining a planar deployed orientation in use. Therefore, the spirit and scope of the appended claims should not necessarily be limited to the description of the preferred versions contained herein.

What is claimed is:

1. An unpowered planing craft for a side-by-side pair of riders, comprising:

(a) a hull having rearwardly projecting and laterally diverging leg portions, a downwardly and outwardly facing planing surface for supportively engaging a fluidic medium when the hull moves forwardly relative to the medium, an upwardly facing deck surface, and a perimeter outline, the deck surface having an area sufficient for supporting side-by-side human bodies kneeling proximate respective front extremities of the leg portions;

(b) stabilizer means laterally spaced substantially within respective ones of the leg portions for interacting with the medium; and (c) a laterally spaced pair of adjustable restraint members extending upwardly from the hull, each of the restraint members being adapted for restraining a respective one of the riders on the deck surface.

2. The planing craft of claim 1, wherein the deck has a deck width proximate the forward extremities of the leg portions, the deck width being not less than approximately 24 inches.

3. The planing craft of claim 2, wherein the hull has a hull width being not greater than approximately 70 inches.

4. The planing craft of claim 3, wherein the deck width is not less than approximately 36 inches and the hull width is not greater than approximately 55 inches.

5. The planing craft of claim 3, wherein the deck width is approximately 40 inches and the hull width is approximately 46 inches.

6. The planing craft of claim 1, wherein the hull has a length being between approximately 90 percent and approximately 120 percent of the hull width.

7. The planing craft of claim 6, wherein the hull length is approximately 113 percent of the hull width.

8. The planing craft of claim 1, wherein the perimeter outline diverges rearwardly along inside edges of the leg portions on opposite sides of a longitudinal axis of the hull, the longitudinal axis projecting rearwardly from the perimeter outline at a reference location, each leg portion having a leg width and a corresponding leg spacing from the longitudinal axis at a leg distance rearwardly of the reference location, a total of the leg width and spacing where the leg distance is approximately 40 percent of an overall hull width of the hull being approximately equal to half of the hull width.

9. The planing craft of claim 8, wherein the perimeter outline diverges at an angle of approximately 30 degrees from the longitudinal axis along the inside edges of the leg portions.

10. The planing craft of claim 8, wherein the leg width is approximately 25 percent of the hull width where the leg distance is 40 percent of the hull width.

11. The planing craft of claim 10, wherein the leg distance is approximately 40 percent of the hull width proximate rear extremities of the leg portions.

12. The planing craft of claim 8, wherein the perimeter outline extends to the hull width at outer extremities of the leg portions.

13. The planing craft of claim 12, wherein rear extremities of the leg portions extend to proximate the hull width.

14. The planing craft of claim 12, wherein a forward portion of the perimeter outline ahead of the outer extremities of the leg portions extends convexly outwardly and forwardly to a forward extremity of the hull.

15. The planing craft of claim 12, wherein a forward portion of the perimeter outline ahead of the outer extremities of the leg portions forms a substantially elliptical arc.

16. The planing craft of claim 1, wherein the hull comprises a rigid structure having a resilient pad affixed thereto, the deck surface extending on an upper surface of the resilient pad.

17. The planing craft of claim 16, wherein each of the restraint members is connectable between a pair of anchor members, the anchor members being located proximate opposite edges of a respective leg portion, the pad extending between the anchor members.

18. The planing craft of claim 17, wherein the rigid structure includes a shell portion and a plurality of reinforcing members fixedly located within the shell portion, the anchor members being fastened to respective ones of the reinforcing members.

19. The planing craft of claim 18, wherein the shell portion has a depression formed therein for receiving the pad and the anchor members.

20. The planing craft of claim 17, wherein each restraint member comprises a flexible strap and each anchor member comprises an arch segment, one end of the strap being looped about and secured to the arch segment of one anchor member, the strap having a strap fastener for adjustably connecting the strap to the arch segment of another anchor member.

21. The planing craft of claim 1, wherein the stabilizer means comprises pair of stabilizer mounts for holding respective stabilizer members longitudinally extending on the hull surface and projecting downwardly therefrom.

22. The planing craft of claim 21, wherein each stabilizer mount includes a reinforcing member within the hull, a threaded opening extending into the reinforcing member from the hull surface for receiving a stabilizer fastener.

23. The planing craft of claim 22, including a pair of downwardly projecting, longitudinally extending skeg members connected to respective ones of the reinforcing members.

24. The planing craft of claim 21, wherein the stabilizer means further comprises the hull surface having at least one laterally spaced pair of channel passages formed therein, each channel passage extending longitudinally from proximate a forward extremity of a respective leg portion, rearwardly to the perimeter outline.

25. An unpowered planing craft for a side-by-side pair of riders, comprising:

(a) a hull comprising:

(i) a rigid shell structure having rearwardly projecting and laterally diverging leg portions, a downwardly and outwardly facing planing surface for supportively engaging a fluidic medium when the hull moves forwardly relative to the medium, an upwardly facing deck surface, and a perimeter outline, the structure having a hull width of between approximately 40 inches and approximately 55 inches, the deck surface having an area sufficient for supporting side-by-side adult human bodies kneeling proximate respective front extremities of the leg portions, a width of the deck surface proximate the front extremities of the leg portions being not less than approximately 36 inches, the structure also having a hull length being between approximately 90 percent and approximately 120 percent of the hull width, the perimeter outline diverging rearwardly along inside edges of the leg portions at an angle of approximately 30 degrees from a longitudinal axis of the structure, a forward portion of the perimeter outline ahead of outer extremities of the leg portion extending convexly outwardly and forwardly to a forward extremity of the hull; and (ii) a resilient pad affixed to the structure in flush relation to the deck surface;

(b) stabilizer means laterally spaced substantially within respective ones of the leg portions for interacting with the medium, comprising the planing surface being formed with a plurality of longitudinal channel passages formed therein, and a laterally spaced pair of downwardly projecting skeg members extending longitudinally under the planing surface;

(c) a pair of anchor members fixedly connected to the shell structure proximate opposite edges of each of the leg portions, the pad extending between respective anchor members of each pair, the anchor members being confined below the deck surface; and (d) a laterally spaced pair of adjustable restraint members connectable between respective pairs of the anchor members, each of the restraint members being adapted for restraining a respective one of the riders on the deck surface.

* * * * *